United States Patent [19]

Bateson

[11] 4,428,085

[45] Jan. 31, 1984

[54] SELF-CLEANING BUILDING CONSTRUCTION

[76] Inventor: Frances G. Bateson, Rte. 5, Box 695, Newburg, Oreg. 97123

[21] Appl. No.: 142,558

[22] Filed: Apr. 21, 1980

[51] Int. Cl.[3] ..... A47K 4/00

[52] U.S. Cl. ..... 4/662

[58] Field of Search ..... 134/18, 94, 99, 115 R, 134/198; 4/662, 449, 546

[56] References Cited

U.S. PATENT DOCUMENTS

| | | | |
|---|---|---|---|
| 3,381,312 | 5/1968 | Whitla | 4/662 |
| 3,713,176 | 1/1973 | Stock | 4/662 |
| 3,720,961 | 3/1973 | Garvey | 4/662 |
| 3,742,520 | 7/1973 | Barnadi | 4/662 |
| 3,747,129 | 7/1973 | Dyar | 4/662 |
| 3,755,826 | 9/1973 | Roberts | 4/662 |
| 3,837,011 | 9/1974 | McTighe et al. | 4/662 |
| 3,869,732 | 3/1975 | Garvey et al. | 4/662 |
| 4,233,692 | 11/1980 | Sinsley | 4/662 |

*Primary Examiner*—Henry K. Artis

*Attorney, Agent, or Firm*—Klarquist, Sparkman, Campbell, Leigh, Whinston & Dellett

[57] ABSTRACT

A self-cleaning building construction comprises apparatus for applying a fine spray or mist of water and/or water and detergent to wall, floor and ceiling surfaces, followed by warm air drying. Floors slope in a direction for removing excess moisture via a drain. Also included are closet apparatus for cleaning clothing, cupboard-dishwasher apparatus for cleaning stored dishes, self-cleaning bathtub apparatus, and self-cleaning washbasin apparatus.

14 Claims, 27 Drawing Figures

FIG. 14
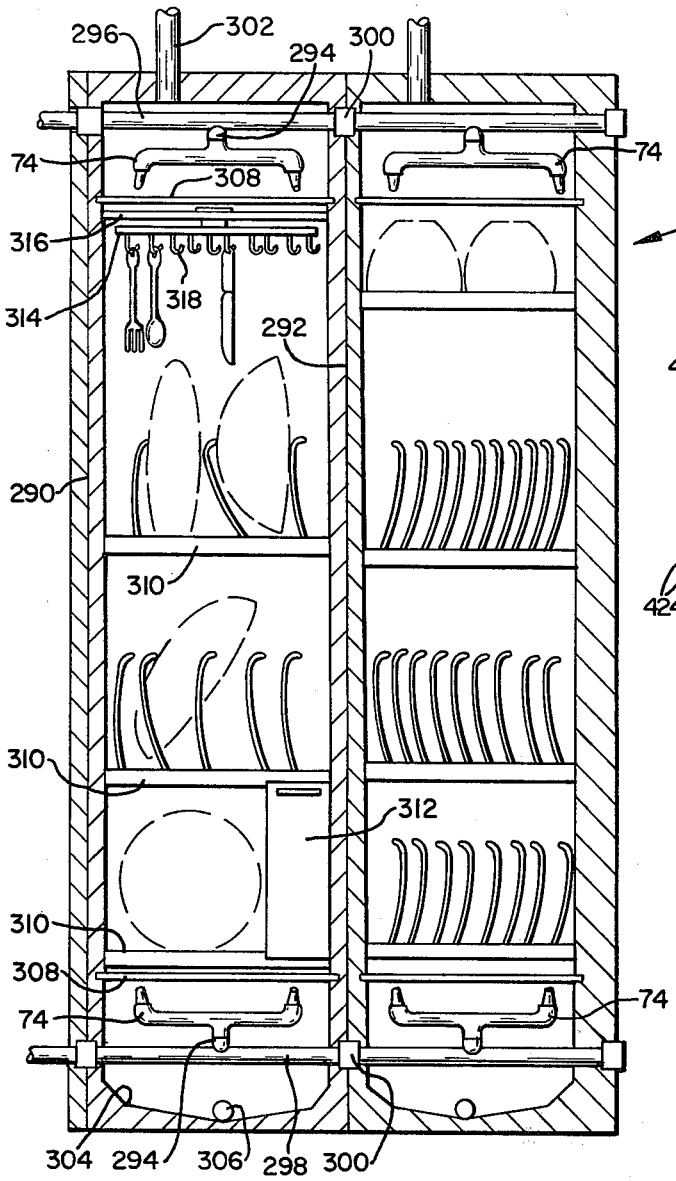
FIG. 18
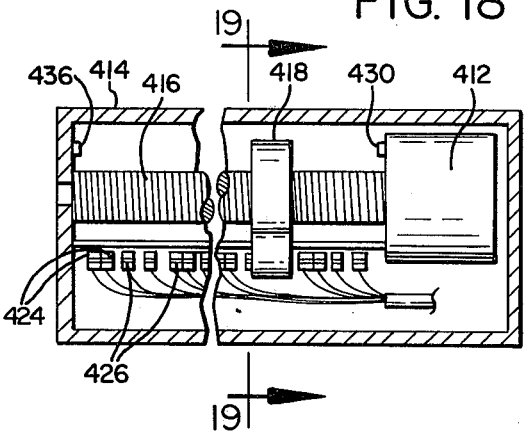
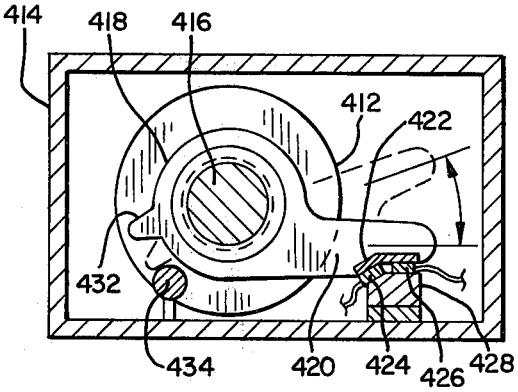
FIG. 19
FIG. 16
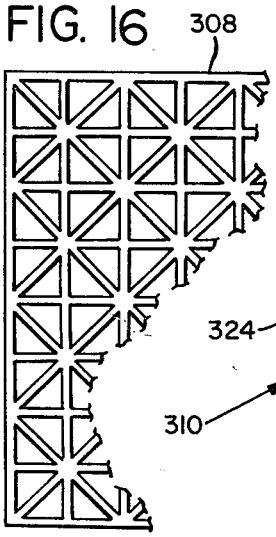
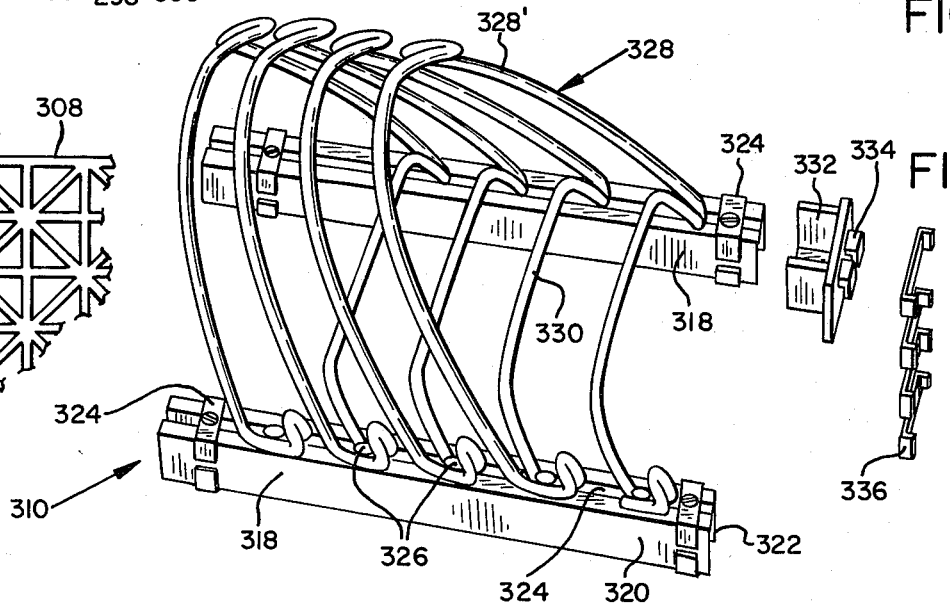
FIG. 15

FIG. 24
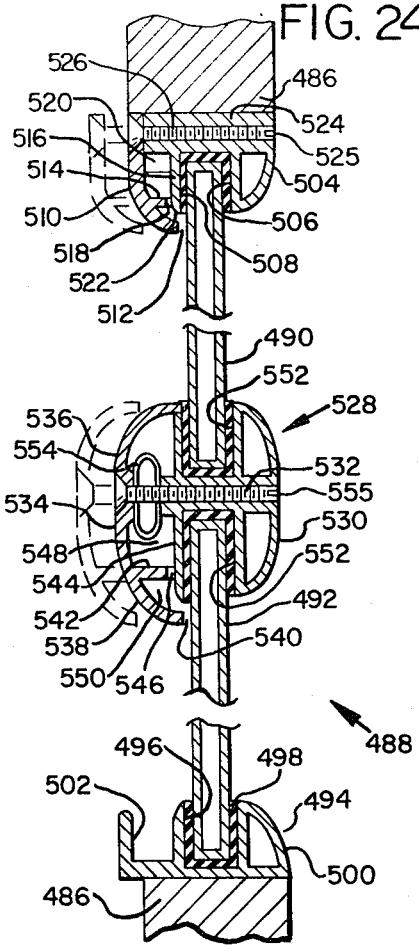
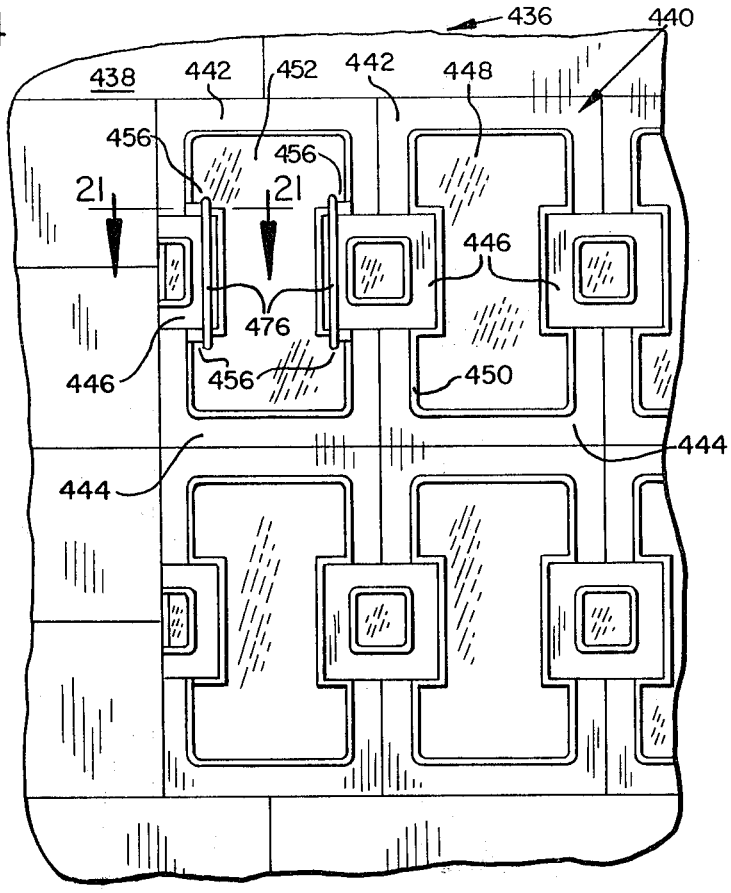
FIG. 20
FIG. 21
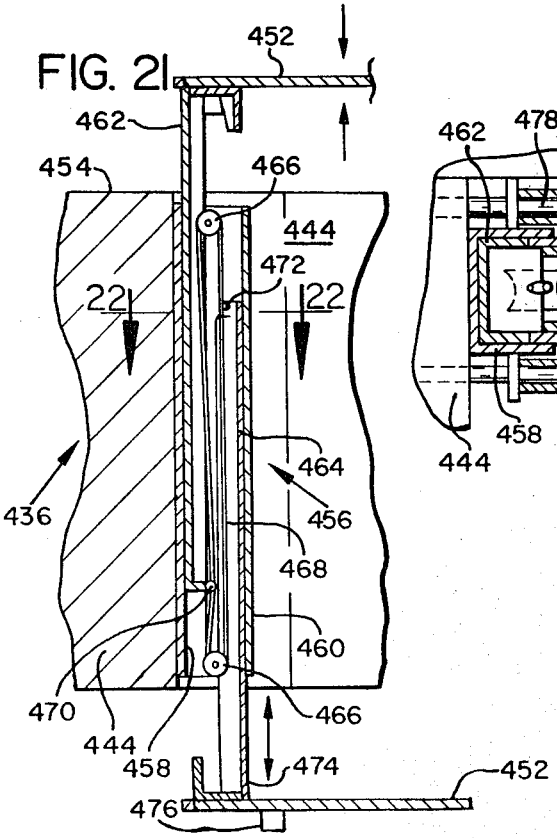
FIG. 22
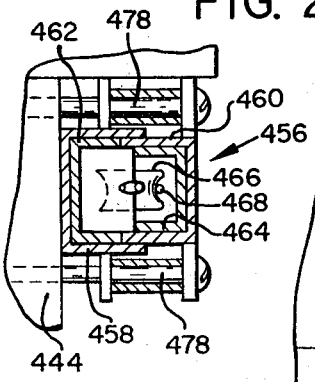
FIG. 23
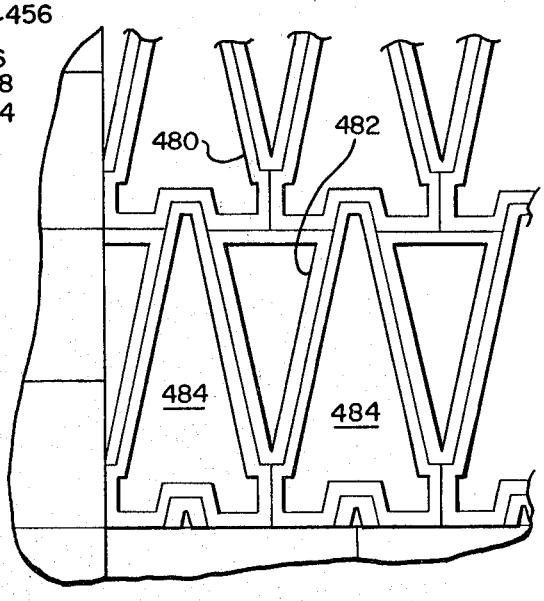

SELF-CLEANING BUILDING CONSTRUCTION

BACKGROUND OF THE INVENTION

The present invention relates to a building construction and apparatus characterized by ease of upkeep, and particularly to a building construction or apparatus wherein cleaning is mechanized and substantially automatic.

Although the average home or building is provided with various laborsaving devices, very little progress has been made toward automation of the basic cleaning of the building itself. Thus, cleaning of wall, floor and window surfaces as well as counter tops, table tops, plumbing appliances and the like involves a great deal of hand labor, with the basic cleaning functions consuming a considerable proportion of the average homemaker's time. In addition, appreciable time is expended in the washing of clothing, dishes, and the like even with the aid of conventional apparatus designed for the purpose.

SUMMARY OF THE INVENTION

According to the present invention, a self-cleaning building construction, including walls, ceiling and floor defining an enclosure, is provided with means for automatically or semi-automatically cleaning the same. Water distribution means are located proximate the ceiling of the enclosure and are adapted to deliver a spray of water or mist to the interior of the enclosure, with the enclosure floor sloping toward a drain for moisture removal. Air delivery means provide movement of air into the enclosure for drying the surfaces after washing. Although water alone may be employed in the washing cycle, a mixture of water and detergent is preferred, followed by rinsing and drying.

In accordance with a preferred embodiment of the present invention, drying air is delivered into the aforementioned enclosure by way of baseboard means located around the floor thereof, said means also being utilized for supplying part of the cleaning water or water and detergent. The means located proximate the ceiling for delivering a spray of water desirably comprises rotatable spray nozzle means suspended from the ceiling and adapted to deliver a fine spray or mist to the surfaces therebelow.

In accordance with another aspect of the present invention, a self-cleaning building or house includes a closet having a clothes freshener area wherein hanging clothes are sprayed with a fine spray or mist of water.

In accordance with another feature of the present invention, a self-cleaning building construction includes a cupboard dishwasher or dish duster for storing dishes and the like wherein the dishes are cleaned in situ.

Another aspect of the present invention relates to self-cleaning plumbing type appliances including a self-cleaning bathtub and self-cleaning washbasin wherein swirling water is peripherally delivered for cleaning.

Another aspect of the present invention relates to window walls adapted for self-cleaning and provided with self-cleaning means and novel opening means.

A further aspect of the present invention pertains to a dry toilet requiring a minimum of cleaning attention.

It is accordingly an object of the present invention to provide an improved, self-cleaning building construction adapted to eliminate handwork in the maintenance of interior building cleanliness.

It is a further object of the present invention to provide an improved building construction having automated means for washing, cleaning and drying the interior surfaces, as well as for interior building heating.

It is another object of the present invention to provide improved plumbing appliances having improved cleaning features.

It is another object of the present invention to provide improved means for maintaining the cleanliness of clothes.

It is another object of the present invention to provide apparatus for the storing and washing of dishes and the like.

It is another object of the present invention to provide an improved window cleaning system.

It is another object of the present invention to provide an improved dry toilet construction.

The subject matter which I regard as my invention is particularly pointed out and distinctly claimed in the concluding portion of this specification. The invention, however, both as to organization and method of operation together with further advantages and objects thereof, may best be understood by reference to the following description taken in connnection with the accompanying drawings wherein like reference characters refer to like elements.

DRAWINGS

FIG. 14 is a vertical cross-sectional view of a cupboard dishwasher according to the present invention;

FIG. 15 is a perspective view of a dish rack employed in the FIG. 14 cupboard dishwasher;

FIG. 16 is a plan view of a grillwork shelf employed in the building construction according to the present invention;

FIG. 18 is a view of a timing apparatus according to the present invention;

FIG. 19 is a cross-sectional view of the FIG. 18 apparatus taken at 19-19 in FIG. 18;

FIG. 20 is an elevational view of a window wall according to the present invention;

FIG. 21 is a cross-sectional view taken at 21-21 in FIG. 20, comprising a cross-sectional view of a window glide according to the present invention;

FIG. 22 is a cross-sectional view taken at 22-22 in FIG. 21;

FIG. 23 is an elevational view of an alternative window wall according to the present invention;

FIG. 24 is a vertical cross-sectional view of another window wall construction according to the present invention;

DETAILED DESCRIPTION

Figure 1:
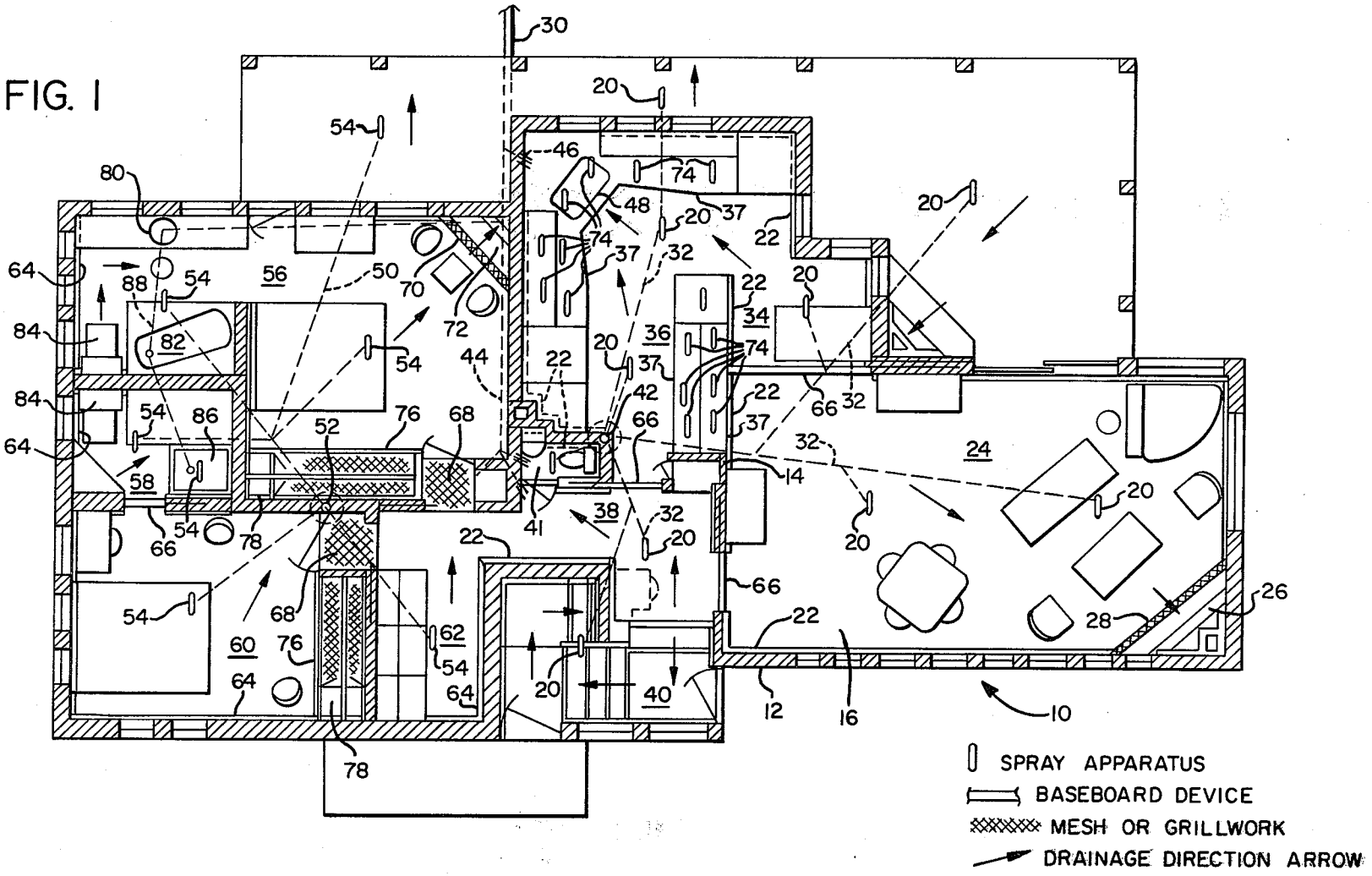
FIG. 1 is a floor plan of a self-cleaning building construction according to the present invention.

FIG. 1 illustrates the general organization of a typical self-cleaning house according to the present invention. Component elements thereof will be more fully described with reference to remaining figures of the drawings. The structure of the house 10 includes exterior walls such as wall 12, interior walls, for example wall 14, floor 16, and the ceiling indicated at 18 in FIG. 2. The interior surfaces of the walls, ceiling and floor forming a particular room or enclosure, together with exposed shelving, counter tops and the like, are substantially waterproof in construction and may comprise wooden surfaces provided with an adequate layer or spar varnish, or may be formed of or coated with other waterproof material. Each room is provided with water distribution means in the form of spray apparatus 20 suspended from the ceiling 18, and a plurality of baseboard devices 22 (FIGS. 4–5) positioned at the juncture between floors and walls. The spray devices 20 and the baseboard devices 22 are adapted to supply a water spray or mist to the interior of the room for washing or cleaning the exposed surfaces thereof, and the same elements, and particularly baseboards 22, are also employed in delivering heated air to the room for drying the cleaned surfaces.

The floors in the house of FIG. 1 such as floor 16 have a slope suitably on the order of one-half inch per ten running feet, with the arrows on the drawing indicating the direction of slope or downhill drainage of water deposited on the surfaces after being expelled from devices 20 and 22. The floor slope direction varies from room to room, and the degree of slope can be adjusted as hereinafter more fully described in connection with FIG. 7. In the case of room 24, the direction of drainage is toward the fireplace corner 26 supplied with an exit grill 28 thereunder into which the accumulated water flows for draining underneath the house. The water may be merely expelled on the ground or through conventional piping to a main watercourse exit pipe or sewer pipe 30.

Devices 20 do not merely apply running water to the room surfaces, but rather a fine spray is produced by devices 20 which impinges surfaces to be cleaned at an angle. Devices 20 receive water or water and detergent at a pressure of about 150 to 200 p.s.i. so that the spray will reach the surfaces to be cleaned and with a suitable cleaning force. Water and detergent are usually applied first followed by a rinse of water alone.

In the house illustrated in FIG. 1, a first water distribution system 32 for ceiling spray apparatus 20 in rooms 24, 34, 36 and 41, hall 38 and stairwell 40 is fed from a common distribution pipe 42 which may comprise a detergent mixer. During the washing portion of a cycle, baseboard devices 22 are fed from the same source in the manner hereinafter more fully described, with the specific piping connections thereto not being shown in FIG. 1. As has been mentioned, the arrows in each room indicate the direction of water flow across the floors. The floors are appropriately sloped in each room toward branches of central watercourse connection 44. For instance, the water flow in kitchen 36 is toward an under-counter drain indicated at 46 beneath sink 48. A second water distribution system is indicated by dashed lines 50 emanating from distribution pipe or detergent mixer 52 and feeding ceiling spray apparatus 54 in rooms 56, 58, 60 and 62, with baseboard devices 64 being fed from the same source. Spray apparatus 54 are substantially identical to apparatus 20, and devices 64 are substantially identical to devices 22. Thus, two separate parts of the house can be cleaned at separate times if so desired. Moreover, the cleaning apparatus in each room can be separately controlled by means of separate solenoid-operated shutoff valves.

In addition to the baseboard devices 22 (or 64) hereinafter more fully described in connection with FIGS. 4 and 5, the same being disposed around the edge of a room, certain door sills as divide one room from another comprise a double sill device 66 as more fully illustrated in FIG. 6. These devices similarly provide water or water and detergent and alternately provide heated air in two separate directions as when the slope of the floor and the direction of water flow is different in adjoining rooms. The double sill devices 66 adjoin room areas where the floor level is fairly high and the natural slope and water flow is away from the sill. The sill devices 66 are connected to respective sources as appropriate for the room locations they adjoin. Where the entryway between rooms is substantially at a low point for each room, the entryway is formed utilizing a mesh or grillwork 68 communicating to the main watercourse 44–30. Such a grillwork comprises the main water exit for room 60, for example. Part of the water from room 56 flows through an entry grillwork 68, but mainly leaves through mesh or grillwork 70 positioned under corner fireplace 72.

Further spray apparatus 74 is illustrated as located within cabinetry 37 in kitchen 36 and is connected somewhat differently from the spray apparatus 20, 54 hereinbefore mentioned. Each of the spray apparatus 74 is located in a dishwasher cabinet or "dish duster" cabinet as hereinafter more fully described, wherein dishes, silverware and the like are normally stored but wherein the same are periodically or selectively washed.

Each of the rooms 56 and 60 is provided with a mesh bottom closet 76 and each closet includes a clothes freshener compartment 78 on one end. As hereinafter more fully described, the clothes are selectively placed in the freshener compartments 78 where they receive a spray or mist. Water leaves through the mesh bottoms of the respective closets and flows into an exit pipe or into adjoining mesh or grillwork room entries 68.

The house of FIG. 1 also includes a novel and self-cleaning lavatory or washbasin 80, bathtub 82 and toilet 84 as hereinafter more fully described. Water from washbasin 80, bathtub 82 and a shower 86 are drained through exit pipe 88 leading to the main watercourse 30. The various items of furniture in the house are either substantially waterproof in nature or are provided with waterproof covering during a wash cycle.

Figure 2:
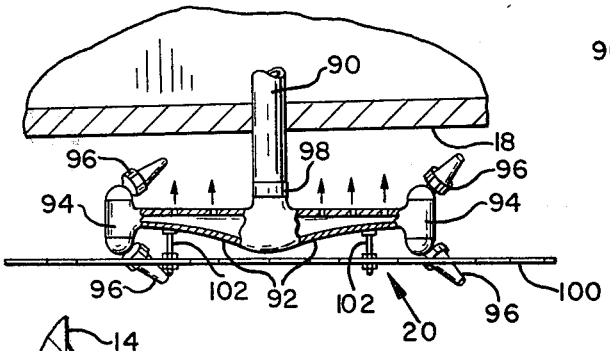
FIG. 2 is a partial cross-sectional view of water distribution means according to the present invention.
Figure 3:
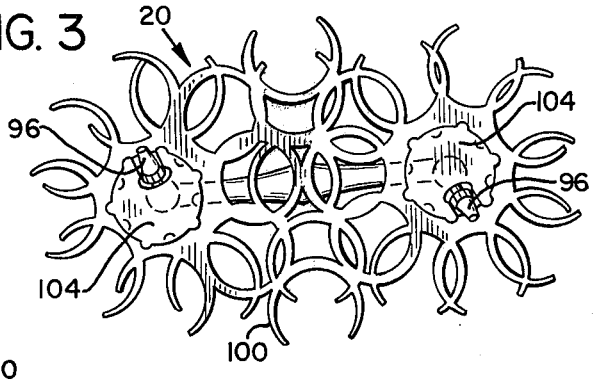
FIG. 3 is a view looking upward toward said water distribution means.

Referring to FIGS. 2 and 3, spray apparatus 20 (or 54 and 74 in FIG. 1) suitably comprises a rotatable, nozzle-type sprinkler provided with water or a combination of water and detergent via pipe 90 extending downwardly from ceiling 18. The sprinkler includes a pair of lateral arms 92 provided with upper orifices and concluding in nozzle mounting hubs 94 each of which rotatably receives spray nozzles 96 which extend primarily upwardly and downwardly from the hubs 94, but which are adjustable in direction and with respect to the fineness of spray. The nozzles are adjusted to supply a fine dispersable spray at an angle onto the cleanable surfaces at a pressure as hereinbefore described. The upper nozzles spray the ceiling 18 while the lower nozzles spray the room or enclosure therebelow with the spray or mist of water, or water and detergent. The nozzles are directed somewhat tangentially in opposite directions as indicated in FIG. 3 whereby the spray apparatus 20 rotates by reaction about rotatable joint 28 on pipe 90 as water pressure is applied. A decorative sheet metal filigree mesh 100 is attached to the underside of arms 92 on bolts 102 to conceal the device from view and the mesh 100 rotates with the device. Included with the mesh are rotatable disks 104 having apertures through which the lower nozzles 96 extend and which may be rotated with the nozzles as desired for adjusting the direction of spray. It will be seen that as appropriate water pressure is applied through pipe 90, the device 20 will apply water and detergent to the surfaces in the room below. Ordinarily the upper nozzles 96 are adjusted to provide a lesser spray on the ceiling 18. As hereinafter more fully described, warm air is subsequently provided through pipe 90 for clearing water from the device after use to prevent dripping and for aiding in drying the room surfaces after washing.

Figure 4:
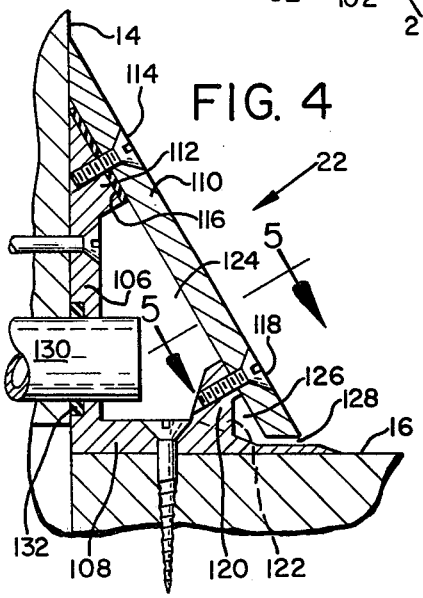
FIG. 4 is a transverse cross-sectional view of baseboard means according to the present invention for delivering water cleaning liquid, drying air, and heating air.
Figure 5:
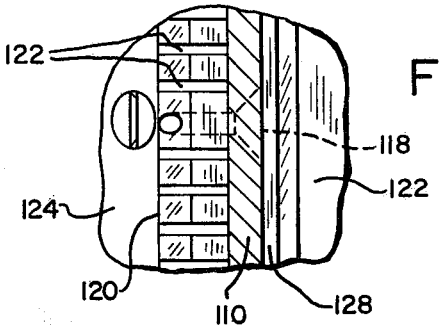
FIG. 5 is a partially broke away view taken at 5-5 in FIG. 4.

Referring to FIGS. 4 and 5, a baseboard or mopboard device 22 (also designated as 64 in portions of FIG. 1 structure) is positioned at the junction between floor 16 and wall 14, or between any of the floors and walls around room edges as indicated in FIG. 1. The mopboard device will be located preferentially at the "high side" of a room, i.e. at the high end of the sloped floor away from the drain. However, the device 22 can also be located around the other sides of the room as well. Referring to FIG. 4, the device 22 includes a metal rearward wall 106 and an integral lower wall 108 which complete an L-shaped cross section and which are respectively joined by means of screws to the wall and floor of the building. A diagonal faceplate 110 extends downwardly from building wall 14 and is joined to a boss 112 of device wall 106 with screws 114, wherein a gasket 116 is interposed between the faceplate and the boss. Screws 118 join the lower part of the faceplate to an upstanding rib 120 forming part of lower device wall 108 having distribution slots 122 therein for the passage of water or a water and detergent mix between feeder chamber 124 and dispenser chamber 126. The lower device wall 108 is canted downwardly to a thinner section in the region of chamber 126 and defines an outlet duct or slot 128 along and under a lower angled edge of faceplate 110.

The device 22 is provided water or a water and detergent mix by way of pipe 130 or a plurality of such pipes located along the device 22 suitably at a lesser pressure than devices 20 such that a controlled flow of water or water and detergent mix is distributed out onto floor 16 through duct or slot 128. A gasket 132 is located around pipe 130. A pipe similar to pipe 130 but larger in cross-sectional area is employed to provide drying air to the interior of device 22 and from there through slot 128 to the interior of the room or chamber served thereby after a washing and rinsing cycle as hereinafter more fully described. The plate 110 is removable as by removing screws 114 and 118 for the cleaning thereof, and particularly for cleaning of possible sedimentation deposits from the distribution slots 122.

The device 22 has been described in connection with its use as a baseboard or mopboard, but is also suitably utilized as wall washer at the junction or corner between a wall and ceiling in which case reference numeral 14 in FIG. 4 would represent the ceiling and reference numeral 16 in FIG. 4 would represent the wall of the room or enclosure extending downwardly from the ceiling. In addition to the washing of conventional walls, this construction is useful in providing a sheet of water for washing and rinsing glass walls or window walls.

Figure 6:
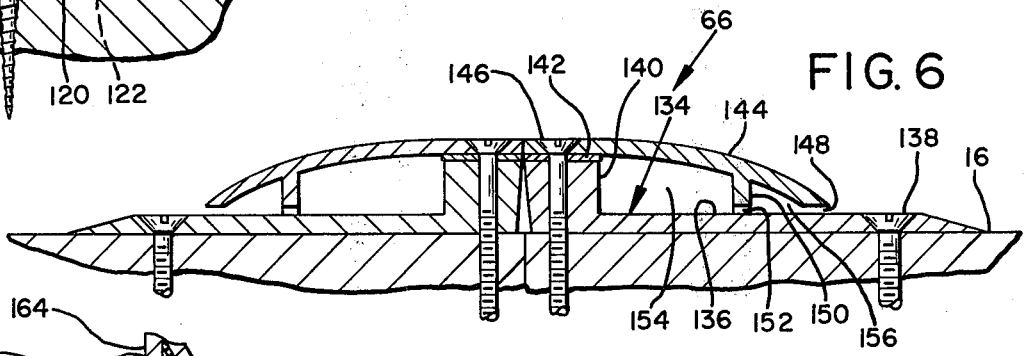
FIG. 6 is a transverse cross-sectional view of a door sill construction according to the present invention.

Referring to FIG. 6, a sill device 66 is illustrated in greater detail, this device being locatable at the entryway between two rooms, the floors of which slope downwardly in opposite directions. The right-hand side of the device will be described, it being understood the left-hand side is a substantial duplicate. Furthermore, one of these devices may be used alone in appropriate circumstances. Sill device 66 includes a lower, metal, L-shaped member 134 having a long lower leg 136 extending along floor 16 and joined thereto by means of screw 138. Upper leg 140 of member 134 is provided with a gasket 142 at its top edge spacing the same from a downwardly curved cover plate 144 which is joined to the upper leg by means of screw 146 extending downwardly through leg 140 and into floor 16. The upper cover plate is designed to match edge for edge with a similar cover plate on the adjoining or duplicate part of the device 66 shown on the left-hand side of FIG. 6 and is curved smoothly downwardly toward lower leg 136 terminating short of the lower leg to define a lower slot or aperture 148. An intermediate partition 150 extends downwardly from cover plate 144 and abuts lower leg 136 about two-thirds of the way along cover plate 144. The partition is provided with lower apertures or slots 152 at close intervals therealong, similar to the slot construction illustrated in FIG. 5, for coupling water or water and detergent mixed from water feeder chamber 154 defined on the upper side of the partition to the water dispensing chamber 156 defined on the lower side of the partition adjacent slot 148. As hereinbefore described in connection with the baseboard device of FIGS. 4 and 5, the device 66 is supplied with water or water and detergent communicating with chamber 154, and the same is distributed through slots 152 and out through slot 148 to floor 16. Also, air drying pipes communicate with chamber 154 for providing drying air to the adjoining room or enclosure. The cover plate 144 is removable by removing screws 146 whereby the interior of the device may be cleaned, particularly as regards possible sedimentation deposits in slots 152.

Figure 7:
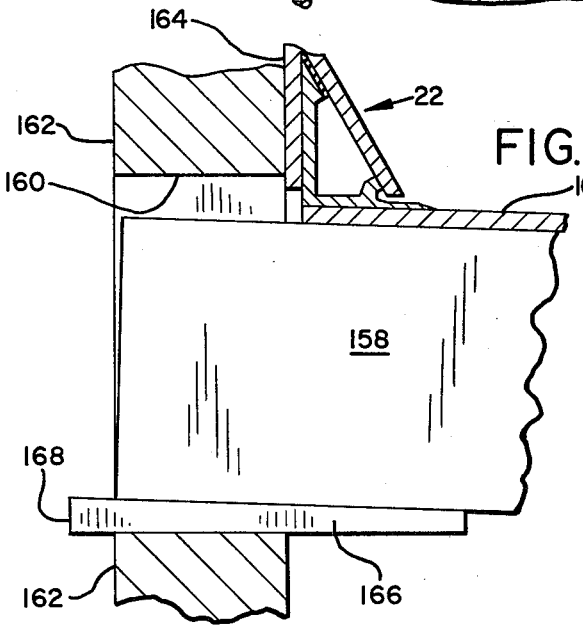
FIG. 7 is a cross-sectional view illustrating means for providing a particular slope for the self-cleaning building construction according to the present invention.

FIG. 7 illustrates the manner in which the desired degree of floor slope is achieved and maintained. A floor joist 148 supporting floor 16 extends through a slot 160 in a wall, for example an exterior wall comprised of concrete blocks or cinder blocks 162. Blocks 162 and panel 164 suitably comprise the "exterior" wall 12 of the house or building. A wedge 166, which may be formed of wood but preferably of metal, is disposed through slot 160 under the edge of each floor joist with the thicker end 168 protruding to a slight extent whereby the same may be driven to the right in FIG. 7 for raising joist 158, or whereby the same may be pulled out somewhat for lowering the joist. The desired slope of floor 16 is initially determined in this manner, and is also maintainable in case the building wall or foundation should settle over a period of time. While an exterior wall construction is shown, it will be appreciated that a similar foundational element is located under each room wall at the high side of the room for determining and maintaining the proper floor slope across the room. A baseboard device 22 is herein illustrated as located at the high side of the room or enclosure defined above floor 16.

Figure 8:
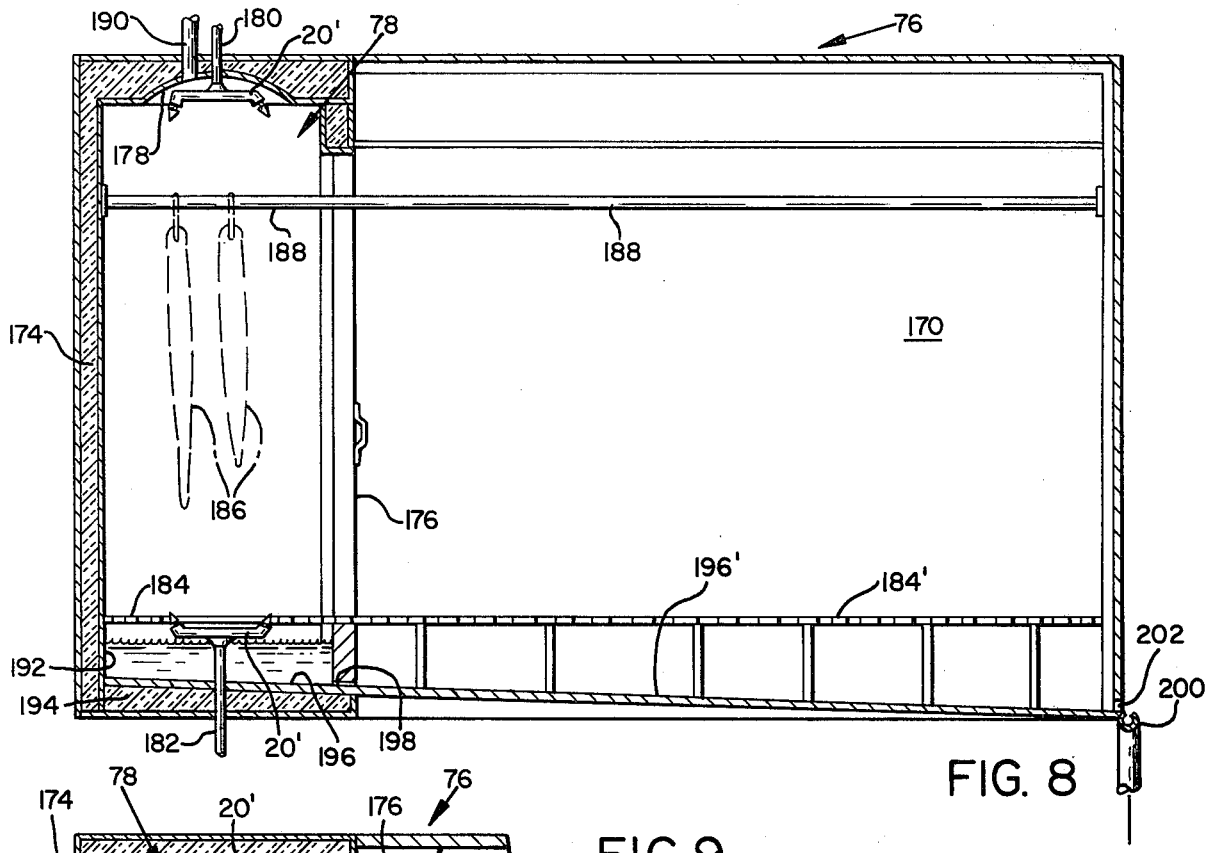
FIG. 8 is a cross-sectional view of a closet including a clothes freshener according to the present invention.
Figure 9:
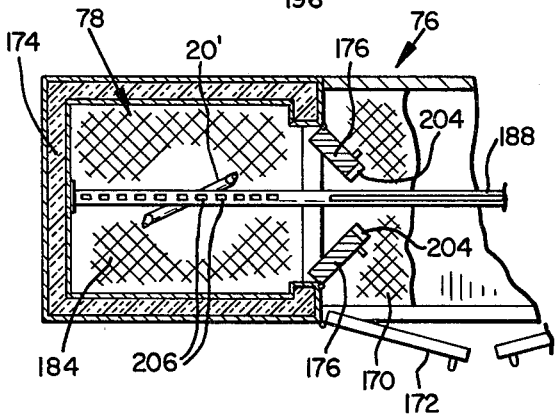
FIG. 9 is a partially broken away horizontal cross-sectional view of the clothes freshener area in FIG. 8.

Referring to FIGS. 8 and 9, illustrating a clothes closet and clothes freshener according to the present invention, the clothes closet 76 comprises a first or outer chamber 170 accessible by exterior doors 172, and an interior chamber or clothes freshener 78 located at one longitudinal end of chamber 170. The clothes freshener chamber 78 is provided with insulated walls 174 and insulated doors 176 for keeping the heat of warmed water within the chamber. The inner wall of the chamber 78 is domed at 178 to receive a spray device 20' extending downwardly from pipe 180 for delivering a spray or mist of water to the clothes freshener. A similar device 20' extends upwardly from lower pipe 182 at the central bottom of the chamber surrounded by lower grillwork 184. The devices 20' are substantially the same in construction and operation as the spray device 20 illustrated in FIG. 2 except that the devices 20' are provided with spray nozzles only on one side as illustrated for directing moisture towards clothes 186 hanging from rod 188 in the chamber 78. The dome 178 at the top of the chamber is also constructed with a vent pipe 190 which is alternatively employed to supply drying air to the interior of the chamber. The interior of the chamber including the bottom thereof is waterproofed, being formed of fiberglass or having baked enamel metal wall construction, and includes a lower catch basin 192 for collecting water. The catch basin is disposed over a sloping subsupport 194, said subsupport positioning a sloping water drain floor 196–196' in both chambers. An opening 198 along the lower wall between the two chambers allows runoff of excess water via floor 196' to the opposite end of the first chamber and drain 200 or other water disposal course accessed through an opening 202 in the far end closet wall. For the saving of water, it is also possible to reuse the water in the lower catch basin portion of the clothes freshener chamber and recycle the same (by means not shown) through sprayer devices 20'. Grill 184 in the clothes freshener chamber also has its counterpart 184' in the first or closet chamber such that any dripping may be collected from dampened clothes.

Clothes rod 188 extends the full length of both chambers through a half opening 204 in each of the doors 176 whereby the doors may be closed therearound during operation of the clothes freshener. A central slot of the top of the rod 188 is segmented as indicated at 206 for separating clothes hanging on hangers in the clothes freshener chamber to insure each item receives an adequate supply of moisture.

In use, the purpose of the clothes freshener device is not to wash and scrub clothing completely, but to freshen the same for rewearing without the necessity of excessive frequent washings. Clothing just worn may be placed in the clothes freshener, e.g. overnight for spraying and drying, after which the same is removed through opened doors 176 to the main portion of the closet. The doors 176 are closed when the clothes freshener is in use. The common rod 188 facilitates the movement of clothing from one compartment or chamber to the other. While both detergent and water may be used, followed by the use of water for rinsing in the clothes freshener, the use of warm water spray alone is preferred, followed by a drying cycle. The control of operation will be more completely described in connection with FIGS. 17, 23 and 24.

Figure 10:
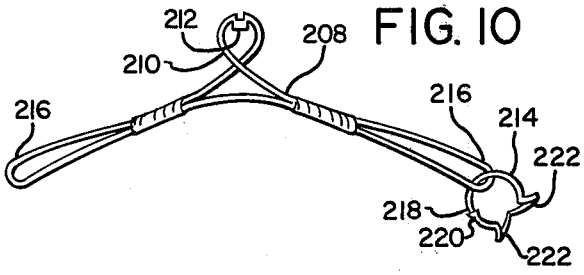
FIG. 10 is a view of clothes hanger adapted for use in the FIG. 8 closet and clothes freshener.

FIG. 10 illustrates a clothes hanger 208 of the type permanently employed in the closet and freshener of FIGS. 8 and 9 having a top loop 210 received around the rod 188 and adapted to slide backwardly and forwardly. The top of loop 210 includes a detent 212 received in the upper slot in rod 188, and particularly in the segmented slot portions 206 of the rod in the freshener in order to separate the items of clothing from one another. A clothespin 214 is engaged through one of the end loops 216 of the hanger 208 and comprises a circular spring metal wire including a needle 218 and a needle socket 220 both on one side of the loop. Finger grips 222 protrude outwardly from the loop construction of clothespin 214 below socket 220, and when urged together between the thumb and forefinger, cause the removal of needle 218 from socket 220. Thus disengaged, the clothespin may be employed to secure clothing to the coat hanger as the finger grips are released allowing needle 218 and socket 220 to engage an article of clothing therebetween. A similar clothespin may be employed on the remote end loop 216 of the hanger.

Figure 11:
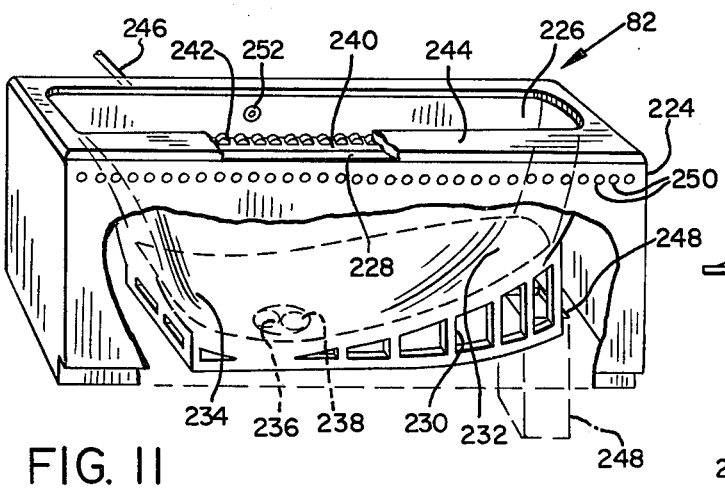
FIG. 11 is a partially broken away, perspective view of a self-cleaning bathtub according to the present invention.

Referring to FIG. 11, illustrating a self-cleaning bathtub 82 according to the present invention, such bathtub comprises an exterior rectangular shell 224, suitably formed of fiberglass or ceramic material, provided with a central tub cavity 226 centrally supported and joined to the outer shell at a rim area 228. The central cavity 226 is also supported from underneath by means of a framework 230 within the shell and underneath the cavity, the cavity being defined such that the foot end 232 is higher in elevation than the rear back end 234. A drain 236 is located near the lower back end, as well as an outlet 238 for a circulation pump (not shown) which may be used in recirculating water from the drain into the tub cavity to provide a continuous water movement action. Conventional plumbing means is employed for opening and closing the tub outlet. The tub cavity is formed with the lower end higher for the purposes of comfort and elevating the feet. Upper rim 228 is provided with a water feeder channel 240 which receives water and/or a mixture of water and detergent via pipe 246 from mixing means suitably of the type hereinafter described with respect to the self-cleaning washbasin of FIGS. 12 and 13. An inner ridge 242 separates the water feeder channel 228 from the interior cavity of the tub, the ridge 242 having a multiplicity of slots for feeding water from the channel 240 into the cavity around the entire perimeter thereof, the action being somewhat similar to the distribution of water and/or water and detergent through slots 122 in FIG. 5. The water feeder channel and the ridge 242 are normally covered by lid 244 formed of fiberglass or ceramic material which covers the water feeder channel and ridge 242 while leaving the slots in ridge 242 open into the cavity of the bathtub. The top of rim 228 suitably comprises a gasket material for preventing the leakage of water in a direction outward from the channel 240. A hot air duct 248 is located underneath the bathtub providing heated air to the hollow interior of shell 224 which escapes through a plurality of orifices 250 on the forward side of the tub used for warming and drying purposes for an individual after he has completed bathing. The heat underneath also heats the tub. An overflow drain 252 is positioned at the upper side of the tub. The lid 244 is removable for cleaning possible sedimentation from the slots in ridge 242.

The water feeder channel 240 not only supplies the normal water and/or water and detergent inlet to the tub, but is also used for cleaning of the same. In either event a valve (not shown), which may be positioned on the wall or operated via electrical solenoids, is operated for admitting the liquid into the tub whereby the entire surface of the interior basin or cavity is reached and cleaned. The water executes a somewhat swirling action.

Figure 13:
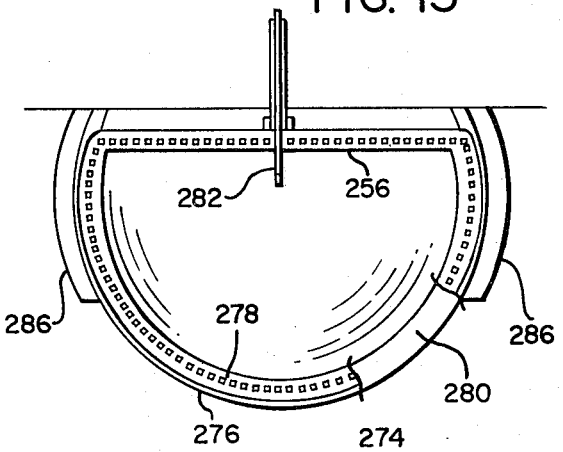
FIG. 13 is a top view of the FIG. 12 washbasin.
Figure 12:
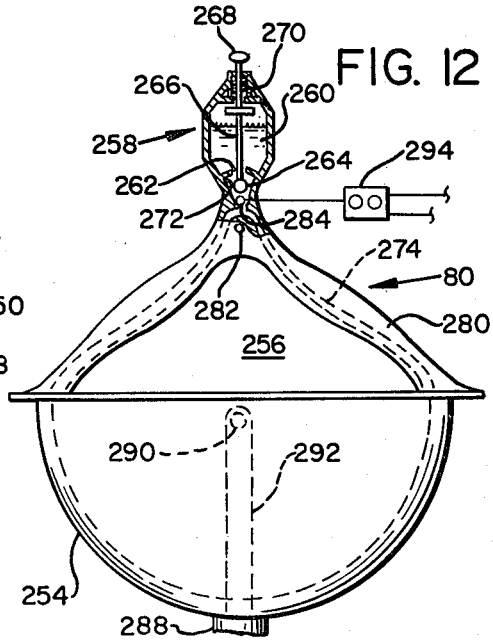
FIG. 12 is an elevational view of a washbasin according to the present invention.

Referring to FIGS. 12 and 13 illustrating a self-cleaning washbasin according to the present invention, said washbasin includes a generally bowl-shaped body 254 formed of fiberglass or ceramic material which is adapted for mounting on the wall or in cabinetry. The washbasin shown is somewhat gothic in style, and is illustrated by way of example although other stylings may be substituted for this general outline. The general configuration is such that excessive projections and the like are minimized whereby the bowl itself is self-washing and the exterior or upper part of the bowl is easily washed, in conjunction with the cleaning of the room wherein the washbasin is located, by means hereinbefore described. The rear of the bowl comprises an upwardly extending splash back 256 minimizing splashing of the surrounding area. At the upper part of the splash back there is supported a detergent mixing apparatus forming an integral part of the washbasin and generally indicated at 258. The upper part of the detergent apparatus includes a hollow detergent containing chamber 260 having a lower outlet orifice 262 closable with check ball 64 disposed at the lower end of plunger shaft 266. At the upper end of the plunger shaft is positioned a detergent release punch knob 268 which is normally spring biased by means of spring 270 to an upward position for closing ball 264 against orifice 262. The spring 270 is located in a small chamber just under the top of the device. When the knob 268 is depressed against spring pressure, detergent is released into a detergent and water mixing chamber 272 immediately under the orifice 262. A water line 284 is connected to chamber 272. Mixing chamber 272 communicates with cleaning channel 274 extending around the top of the washbasin defined between an outer ridge 276 and an inner ridge 278 having a multiplicity of slots, in the manner of ridge 242 in the bathtub of FIG. 11. The channel 274 is normally covered by a lid 280 which rests upon sealing material disposed along the top of ridge 276. This lid is removable as in the case of lid 274 in FIG. 11 for cleaning possible sedimentation deposits from the apertures or slots along ridge 278, but normally directs water and/or water and detergent from channel 274 into the interior of the washbasin around the top edge thereof for either filling the same when used in washing, or providing a swirling action for self-cleaning. It will be noted the entire interior surface of the washbasin is flushed thereby for cleaning. The lid 280 presents a curved upper surface to which spray or mist is applied as the room is cleaned in which the washbasin is located. The dispensing apparatus 258 comprises an upper extension thereof and is similarly cleanable.

For the purpose of providing a small stream of water as for brushing one's teeth, a small pipe or spout 282 extends outwardly from the back of the device and is plumbed to a conventional water supply.

Water line 284, as well as the line for spigot 282, are valved and remote controlled with electrical solenoids operated by means of conventional foot switches located on the floor in front of the washbasin. The solenoid valve for line 284 is indicated at 294. A top flange 286 is located at the left and right sides of the basin for counter top mounting. A basin drain 288 is positioned at the bottom of the bowl, while an overflow drain 290 is connected thereto by means of pipe 292. The water will swirl in a washing motion as it drains out the drain opening. The drain 288 is suitably opened and closed employing conventional plumbing means which may also be remotely operated by electrical solenoids.

Although the dispensing and mixing apparatus 258 is of particular advantage in connection with washbasin 12, such a dispensing and mixing apparatus can also be utilized in connection with bathtub 82 of FIG. 11 in which case the outlet thereof communicates with pipe 246 such that water and/or mixture of water and detergent is supplied to channel 240 of the bathtub.

Referring to FIGS. 14 and 15, illustrating a cupboard-dishwasher 288 according to the present invention, such apparatus is comprised of cabinet sections, for example sections 290 and 292 which comprise a portion of the cabinets 37 in FIG. 1. Each section, for example section 290, comprises a rectangular insulated enclosure formed of a waterproof material, or at least having a waterproof interior surface, surrounded by insulation and an insulated door or doors (not shown in FIG. 14) on the forward side. The cabinet sections may be constructed with varying heights, for example substantially floor to ceiling height as illustrated in FIG. 14, or may be constructed in shorter versions for under-counter-top positioning. Each section, for example section 290, is suitably provided with spray apparatus 74 proximate the upper and lower cabinet section extremities, the spray apparatus 74 being substantially the same in construction and operation as the hereinbefore described spray apparatus 20'. Thus, nozzles are included only on one side. The spray apparatus is joined via rotatable connection 294 to horizontal water and/or water and detergent pipes 296 and 298 extending horizontally near the upper and lower extremities of the cabinet sections including pipe connections 300 at the cabinet sides for feeding adjoining cabinet sections. The pipes 296 and 298 are suitably plugged at the end of a line of cabinets. The nozzles of the spray devices are oriented in such a way that the devices will be self-rotating. Each cabinet section has an air vent pipe or dryer pipe 302 by means of which drying air is supplied to the respective cabinet sections, and the lower portion of each section, below the door thereof, comprises a catch basin 304 leading to an outlet drain 306. Grillwork dividers 308 and 310 are located below and above the respective spray devices 74 at the upper and lower ends of the cabinet sections, while intermediate to the protective grills are positioned a plurality of open racks 310 illustrated in greater detail in FIG. 15. The lowest rack further supports a silverware holder 312. Immediately adjacent to the upper grill 308, in the case of the particular cabinet section 290 illustrated, a lazy susan 314 is supported on perforated cross member 316 and carries a plurality of hooks 318 on which various items of cutlery are hung.

The cabinet sections are not employed merely for the insertion of dirty dishes with the removal thereof after a washing and drying cycle, but are intended as the permanent cupboard storage of dishes, cutlery, silverware, etc. The necessary items are withdrawn from a cabinet section for a meal, and are afterwards scraped and reinserted at the same storage locations. The storage locations are oriented so that there is a minimum blocking of water streams and/or water-detergent streams ejected from the nozzles of the spray devices 74, the lower spray device washing and rinsing the undersides of the dishes, while the upper device 74 washes and rinses the upper sides of the dishes. If desired, siphon means may be connected to outlet drain 306 for returning water for reuse. Otherwise, the cupboard-dishwasher sections are operated by the system as described in connection with FIG. 17. Usually, clear, tepid water will be employed at a predetermined pressure for a first portion of a cycle after which warmer water is utilized with detergent added. At a subsequent time, clear, tepid water will again be employed for rinsing after which warm drying air will be provided both via air pipe 302 and via the spray devices 74.

Some of the cabinet sections are employed primarily as "dish dusters" for dishes that are not regularly used but merely need to be maintained in a clean condition. In such case, it is preferred to employ a spray device 74 only at the bottom of the cabinet section, and by means of which only warm water is applied to the dishes. The water is forced upwardly to the top of the device and will then fall back to the drain, and no washing cycle is utilized. Warm air is then employed for drying if desired.

Referring particularly to FIG. 15, the rack 310 includes a pair of parallel spaced rails 218 each comprised of two sections 320 and 322 held together by expansion feet 324. Sections 320 and 322 have upper horizontal flanges extending toward one another and defining a slot 324 therebetween for receiving fasteners 326 which adjustably secure wire-like dish holders 328 to the rails 318 and 320. The dish holders 328 include an upper looped section 328' and a lower cross member 330, which suitably extends to the next looped section. The dish holders are formed of somewhat flexible, coated, wire-like material of a conventional type, but are movable along rails 318, 320 and with respect to one another to accommodate differing size dishes and the like. Rail end rests 332 hold up the rail ends and include rear brackets 334 which attach to rack supports 336 disposed along the inside walls of the cabinet sections, whereby the racks may be removed and adjusted to different levels as desired.

An alternative form of kitchen cabinet shelf, or a shelf that may be employed elsewhere in the same building, is illustrated at 338 in FIG. 16 and comprises a flat, perforate metal or plastic member which allows lint and dust to fall through where it can be picked up by cleaning apparatus, in addition to allowing the flow of cleaning moisture where such is employed. In the areas where dust and lint are the only cleaning problem, such as clothes drawers or linen closets, the perforate shelves help to avoid the accumulation of dirt and dust.

Figure 17:
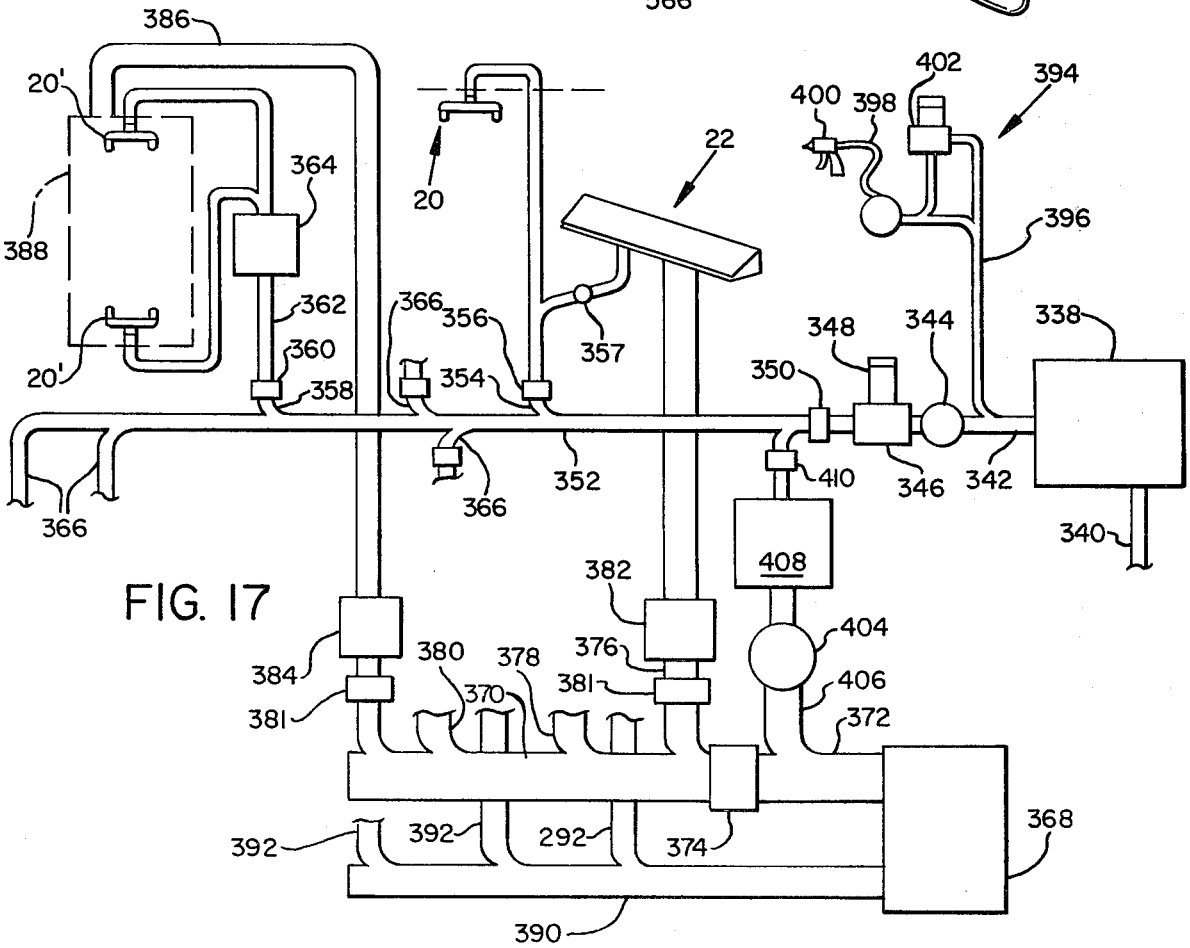
FIG. 17 is a diagrammatic representation of plumbing and heating connections for the building construction according to the present invention.

It is not necessary to employ a separate water and/or water and detergent supply for separate areas of the FIG. 1 house and for the closets 76, the dishwater cupboards, etc. Instead, a central supply system is utilized in conjunction with the central heating system as illustrated in FIG. 17. The timed control thereof will be subsequently described.

Referring to FIG. 17, a central water source 338 is of a conventional nature, receiving water from water main 340 and including heating means typically in the form of a gas or electric heater for heating water, and including controllable means for mixing heated water and cold water to provide water of predetermined temperature at distribution pipe 342. A pump 344 receiving water from pipe 342 drives the same through mixer 346 having associated detergent tank 348 which has an electrically operated valve for adding detergent to the water flow received by the mixer. The output of the mixer is supplied through solenoid valve 350 to secondary distribution pipe 352 which branches to various utilization means through appropriate valving. For instance, branch pipe 354 controlled by solenoid valve 356 supplies water and/or detergent and water to spray devices 20 and baseboard or mopboard devices 22 (suitably through a pressure reducer 357) for a room or section of the house illustrated in FIG. 1. A further branch pipe 358 is coupled to supply pipe 362 of a device 388, which may comprise a dishwasher cupboard, or a closet, through valve 360, whereby water and/or detergent and water are selectively supplied to spray devices 20' (or 74) of the closet or dishwasher cupboard. An electrically operated auxiliary pipe heater 364 or similar auxiliary water and air heating means is associated with pipe 362, particularly in the case of a dishwasher cupboard application. Branch pipes 366 are connected to other appliances or sections of the house comprising rooms or groups of rooms.

A central furnace 268 supplies heated air to duct 370 by way of connecting duct 372 and blower 374. Branch ducts 376, 378 and 380 convey heated air to various portions of the house for heating purposes, and to appliances for drying of clothes, dishes, etc. The branch ducts suitably include air valves or dampers 381 for turning off and on the flow of air. Branch duct 376 is coupled to baseboard device 22 for supplying not only heating air to the interior of a room, but also for drying the room surfaces after a spray or mist has been applied thereto for cleaning. An auxiliary heater 382 is shown disposed in surrounding relation to duct 376 for selectively heating this duct when, for example, it is desired to heat only one area via one baseboard device or group of devices 22. The same auxiliary heating for an individual duct or ducts is applied to air ducts leading to a cupboard dishwasher, for example when it is desired to apply drying heat to the cupboard dishwasher when the duct system 370 is employed for air conditioning or air circulation purposes without heat. Thus, auxiliary heater 384 is disposed in surrounding relation to branch duct 380 having an outlet 386 for device 388. A cold air return duct 390 is also associated with furnace 368 and is connected to branch ducts 392 leading to cold air registers in various sections of the house which registers are conventional except for being positioned in such a way as to avoid excessive water intake when the section of the house is being cleaned.

An air compressor 404 also receives heated furnace air from duct 372 via branch duct 406 and supplies heated compressed air to a tank 408. The latter communicates via solenoid valve 410 to pipe 352 for the purpose of supplying air to the various spray devices and water distribution devices to aid in the heating and drying process after washing, and to dispel moisture from the various water spray devices.

One or more spot cleaning devices 394 are also suitably located in closets or cupboards throughout the house and include a pipe 396 communicating with pipe 342 leading to water source 338. The spot cleaner consists of a flexible or coiled hose 398 provided with a nozzle indicated at 400 and a controllable solenoid switch 402 by means of which detergent can be added to the water stream. The hose is turned off and on by conventional hand valve means. Thus, an individual area can be sprayed with water when particularly soiled if the general cleaning apparatus needs to be supplemented.

As will be appreciated, the functions of the various spray devices, heating devices and the like are thus centrally controllable, and are desirably cycled through various wash, rinse and drying routines on a synchronized or timed basis. It is thus not necessary to supply separate wash and rinse source means for the cupboard dishwashers and the room cleaning apparatus, but since essentially the same problems of cleaning occur in either case, the central source of water, detergent and heat can be employed for both. In some instances, individual manual control of the various units is desirable and can be accomplished with remote switching of the various solenoid valves, or valving at the outlet piping. However, a centrally controllable schedule of washing and drying is desirable from the standpoint of economy of water and heat, and because of the convenience attendant to an automatic system.

Referring to FIGS. 18 and 19, a timing device is illustrated for operating self-cleaning apparatus according to the present invention. The timing device illustrated in the drawing has relatively few contacts and would be suitable, for example, for operating a cupboard dishwasher cycle. However, as hereinafter more fully described, a device of this type is suitable for controlling and timing the overall cleaning cycle of the house and appliances thereof. Slow speed motor 412 located in housing 414 drives feed screw 416 which threadably engages contact nut 418. As the feed screw 416 rotates in a clockwise direction, as viewed in FIG. 19, contact nut 418 is moved from left to right as illustrated in FIG. 18. Contact nut 418 carries an arm 420 provided with electrical contact 422 which selectively makes connection with stationary contacts 424 and 426 supported on insulating base 428. When the feed screw positions nut 418 adjacent a pair of contacts 424, 426, the movable contact 422 completes a circuit therebetween for operating one or more solenoids or devices illustrated in FIG. 18. Various devices or house sections are energized in consecutive order such as to provide soak, wash, rinse and dry cycles and the like. When particular devices, for example a cupboard dishwasher or series of cupboard dishwashers, are operated, the remainder of the devices employed for washing purposes are desirably interlocked to prevent simultaneous operation thereof. A typical cycle would cause the delivery of warm water via pipe 358 to spray devices 20' (or 74) by operation of solenoids 350 and 360 and simultaneous operation of pump 344. The water source 338 is controlled to supply tepid water, or alternatively auxiliary heat device 364 is operated. After completion of a preliminary rinse cycle, the mixer 346 is energized for supplying detergent, while the water temperature is raised either at source 338 or by means of auxiliary heater 364. After the detergent wash, the rinse is once more initiated, followed by termination of the supply of water and the initiation of the supply of air through operation of air valves or dampers 381.

After movement of nut 418 from left to right as viewed in FIG. 18, the nut contacts a motor reverse button 430 causing the feed screw 416 to reverse for moving nut 418 back to the left. At such time, the nut 418 rotates in a counterclockwise direction away from the contacts as viewed in FIG. 19 such that brake 432 extending outwardly therefrom moves against a rail 434, and while the nut moves backwards no electrical connection is completed. When the nut 418 reaches the left-hand end of the device, the nut operates motor-off switch 436 for turning off motor 412 until such time as the cycle is re-initiated.

Although the particular control apparatus of FIGS. 18 and 19 has been described in conjunction with the operation of a cupboard dishwasher, it is readily apparent that the same is suitable for cycling through the cleaning of a complete house, either on a section-by-section basis or room-by-room basis to bring about soaking, washing, and drying. The same control is also clearly applicable to the closet and clothes freshener operation, either separately or in conjunction with room cleaning operations. The same control apparatus, having a greater number of contacts, can cycle through the operation of room cleaning devices, dishwasher cupboards and clothes fresheners if desired. As hereinbefore indicated, individual contacts or sets of contacts are selectively energizable via conventional switch means (not shown), and are manually operable as desired.

FIG. 20 illustrates a wall construction 436 according to the present invention including a "wall of windows" adapted to contribute to the self-cleanability of the house or building while enhancing its appearance. The wall is comprised of concrete blocks or similar blocks 438 having substantially waterproof surfaces provided by paint or other coating. Set in with the wall blocks 438 are a plurality of window block components turned ninety degrees from the conventional concrete block building configuration so as to provide apertures in the completed wall. For example, a window area 440 comprises an upper half block 442 and a lower half block 444 turned with their openings perpendicular to the plane of the wall. Smaller blocks 446 space the half blocks 442 and 444 from one another, with the blocks 446 also being turned so that their apertures extend through the completed wall. As illustrated in the drawing, the same pattern is repeated to form a plurality of openings or windows wherein smaller blocks 446 space pairs of adjoining half blocks 442 and 444. Each of the openings is closed with a transparent windowpane which is flush with the outside wall surface, and preferably panes are flush with both the inside wall surface and outside wall surface both to enhance cleanability and insulation qualities. The panes, such as pane 448, are suitably formed of glass joined around the edge thereof to the concrete block edges with a resin material 450. The windowpanes may alternatively be completely formed of resin, or may have a colored or translucent appearance rather than being transparent if so desired.

Window 452 is provided with an opening device rendering the same movable toward and away from the exterior wall side 454 as illustrated in FIG. 21. Windowpanes 452 are supported on several wall glides, one of which is illustrated at 456 in FIGS. 21 and 22. The glide includes exterior channel frame members 458 and 460 which are interlocked to form an enclosure rectangular in cross section that receives interior slidable members 462 and 464. Pulleys 466 mounted on channel member 458 have a cord 468 entrained therearound making a continuous loop attached to slide member 462 at location 470 and slide member 464 at location 472. The windowpanes 452 are attached to the exterior ends of slide members 462 and 464, while the interior end 474 is also attached to a handle 476 employed for the purpose of operating the window. When handle 476 is moved away from the interior of the wall carrying the inner pane 452 away from the wall, the cord 468 will drive member 462 outwardly from the outside of the wall carrying outer windowpane 452 outwardly. As illustrated in FIG. 20, four such glide devices may be employed with each movable window 452, with pairs of handles 476 joining glides located in vertical alignment along the edge of the window 452 at the upper and lower corners of smaller blocks 446. Masonry screws 478 join the glide devices 456 to the block construction.

FIG. 23 illustrates an alternative window wall construction, including decorative blocks 480 and 482 which are joined as shown to provide an attractive window appearance. Again, windowpanes indicated at 484 are attached in flush relation to the openings between the blocks so as to form a readily washable window wall.

As hereinbefore mentioned, devices substantially identical to baseboard devices 22 can be employed at the junction between wall and ceiling for washing down a wall which may include portions of the type illustrated in FIGS. 20 and 23.

An alternative window washing apparatus is illustrated in FIG. 24 which is particularly adaptable to more conventional multi-pane windows, as for example employing a molding or frame around the edge thereof and cross moldings separating vertically spaced panes. This construction is also efficacious in washing the outside of windows. In this construction, which is suitably formed of metal, the frame at the upper edge of the window, as well as the cross molding separating panes, are employed for providing a washing solution, while the lower frame collects the washing solution. Referring to FIG. 24, a wall indicated in cross section at 486 is provided with a window construction 488 according to the present invention, which supports insulated panes or double panes 490 and 492 in vertical alignment. The lower support frame element or metal sill 494 includes a vertically upward open groove 496 receiving pane 492 with a rubber cushion 498 being located between the sill and the windowpane. The interior of the sill is rounded at 500, and the exterior is provided with a trough 502 for collecting water. The interior of the upper part of the frame 504 is rounded and this part also includes a groove 506 receiving pane 490, with an intermediate rubber cushion 508 being located between the pane and the groove. The exterior side of frame portion 504 includes an outer wall 510 curved downwardly and inwardly toward pane 490, being spaced from pane 490 defining a slot 512. A horizontal leg 514 extends in a direction inwardly from curved wall 510 and abuts inner wall 516 adjacent the windowpane and rubber cushion. Leg 514 is provided with a multiplicity of slots 518 therealong in the manner illustrated for device 22 in FIG. 5 whereby water and/or water and detergent supplied upper chamber 420 above leg 514 is coupled through the slots to a lower dispensing chamber 552 adjacent the windowpane and providing water and/or water detergent through slot 512 for washing the windowpane. The wall 510 is movable to a position as indicated in dashed lines and is secured into main body 524 by means of screw 526 which is operable by a slot 525 at its inner end. The wall 510 is thereby movable outwardly for cleaning possible sedimentation deposits from the multiplicity of slots 518. It will be understood that water and/or water and detergent is supplied to the chamber 520 in the same manner as this fluid is supplied to the aforementioned baseboard devices 22.

The central molding 528 is similarly constructed but is supported at window sides (not shown) to space and locate panes 490 and 492. A rounded inside member 530 is joined by screw 532 to a rounded outside member 534, the latter being movable as indicated in dashed lines. The upper part of the outside member 534 is rounded at 536 while the lower part, 538, is rounded toward a lower slot 540, with a horizontal leg 542 extending from the rounded portion 538 to inner wall 544. A multiplicity of slots 546 extend (in the manner of FIG. 5) along the leg 542 for liquid communication between chamber 548, provided with water and/or water and detergent, and lower dispensing chamber 550 from which the water and/or water and detergent flows through slot 540 and along the surface of the pane 492. Chamber 548 is supplied in the same manner as fluid is supplied to baseboard devices 22. The interior part 530 forms upper and lower slots 552 with wall 544, the same being provided with rubber cushioning to receive the panes in the same manner as hereinbefore mentioned with respect to the upper and lower frame elements. A leaf spring 554 tensions the member 534 outwardly. Screw 532 may be loosened by means of a slot 555 at its inner end whereby spring 554 automatically moves member 534 outwardly for cleaning of slots 546. This is particularly useful in the case of high rise buildings and the like.

It will be seen the upper part of molding member 528 is closed so water may flow thereover, while the lower part is similar in construction to the upper frame portion 504. Water and/or water and detergent supplied to both upper frame portion 504 and molding member 528 function to wash the window surfaces even though the same are somewhat inset from the wall surfaces. Water pressure is adjusted to produce a water sheeting action as a result of the water distribution via slots 512 and 540 which cleans the window surfaces without spotting. Drying air may be supplied via the same device. Trough 502 is piped to a conventional drain.

It will be apparent that the window apparatus as illustrated in FIG. 24 may be reversed to wash the window interior. Moeover, the device can be made symmetrical, i.e. by substantially duplicating on the right-hand side the structure shown in FIG. 24 on the left-hand side of the window center line for washing both surfaces.

Figure 26:
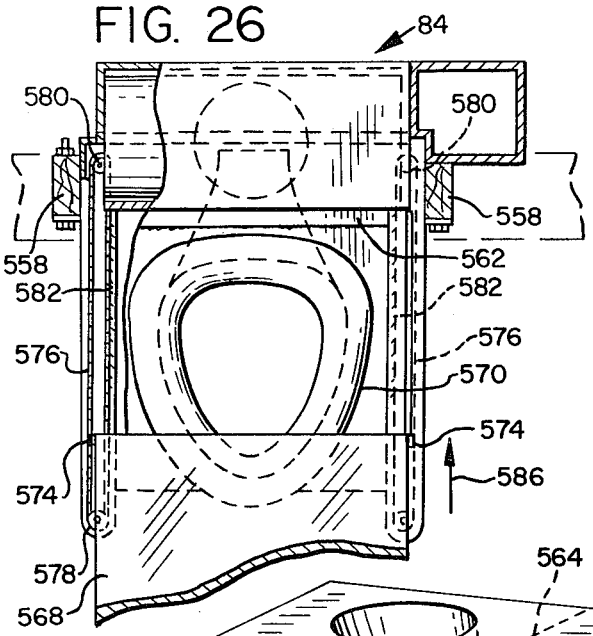
FIG. 26 is a top view, partially broken away and partially in cross section, of the FIG. 25 dry toilet.
Figure 25:
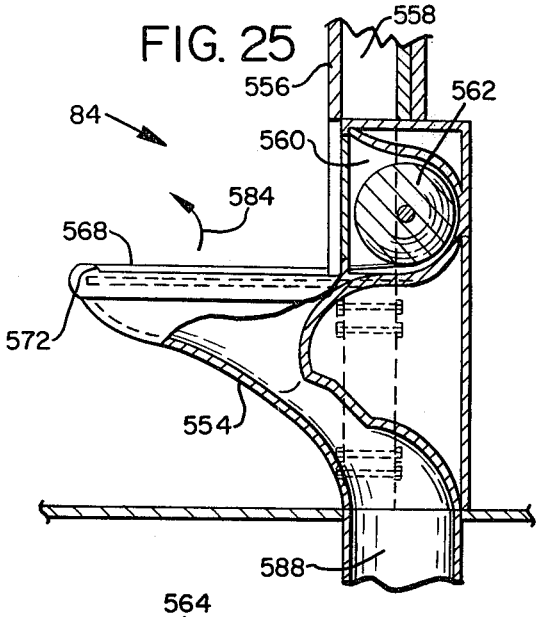
FIG. 25 is an elevational view, partially in cross section, of a dry toilet according to the present invention.
Figure 27:
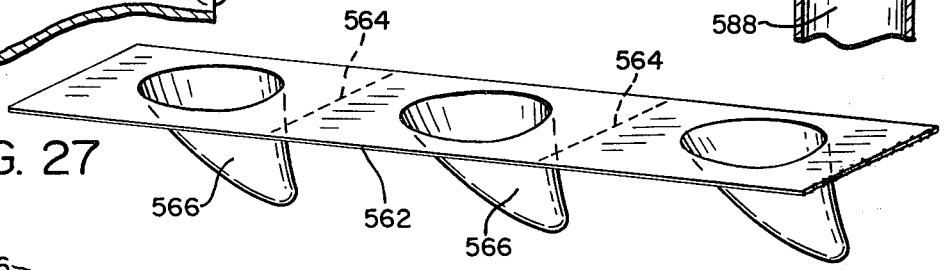
FIG. 27 is a pespective view of a liner employed in the FIG. 25 dry toilet.

Referring to FIGS. 25 through 27, illustrating a dry toilet 84 according to the present invention, the toilet bowl neck 554 extends outwardly from the wall 556 which includes studs 558. Part of the mechanism of the toilet is encased in the wall including a liner cabinet 560 housing a roll of liners 562 further illustrated in FIG. 27.

The liners are formed of a disposable paper material joined at perforations 564, and each containing a backward sloping pocket or pouch 566 for receiving refuse. The pockets are normally folded with the rest of the liner on roll 562.

A lid 568 normally closes over toilet seat 570 and is hinged at the front edge 572 to pivots 574 connected to the outer courses of continuous chains 576. The chains 576 are disposed in a horizontal plane and pass around forward pulleys 578 at the front of the toilet and rearward pulleys 580 at the rear of the toilet. Each of the chains further includes forwardly extending barbs or teeth 582 adopted to contact the nap edge of the liner 562.

To use the toilet, the lid 568 is tilted upwardly in the direction of arrow 584 in FIG. 25, and then is urged in a rearward direction as indicated by arrow 586 in FIG. 26 in wheelbarrow fashion whereby the outer course of each of the chains 576 is urged rearwardly. At the same time, the inner course is urged forwardly causing barbs or teeth 582 to engage the nap edges of liner 562 to pull the next section of the liner forwardly over the seat. The lid 568 may then be leaned against cabinet 560. To dispose of a used liner, the same is separated at a perforation 564 which will be at the rear of the toilet seat, e.g. by a knife means located along the rear of the toilet seat, allowing the liner to drop into the discharge orifice 588. The toilet seat 568 is drawn forwardly and closed. The pit to which orifice 588 leads may comprise a conventional chemical disposer or the like.

While I have shown and described several embodiments of my invention, it will be apparent to those skilled in the art that many changes and modifications may be made without departing from my invention in its broader aspects. I therefore intend the appended claims to cover all such changes and modifications as fall within the true spirit and scope of my invention.

I claim:

1. A self-cleaning building construction comprising:

walls, ceiling and a floor defining an enclosure wherein said floor slopes with respect to the horizontal toward a drain and wherein surfaces of said walls, ceiling and floor are substantially waterproof, water distribution means located proximate the ceiling and adapted to deliver a spray of water or mist to the interior of said enclosure for cleaning said surfaces and exiting along said sloping floor into said drain, and baseboard means in said enclosure, said baseboard means comprising an elongated structure including a feeder chamber, means for providing water to said feeder chamber, and a forward dispensing chamber receiving water from said feeder chamber and having a forward slot adjacent said floor for distributing water therethrough along an edge of said floor and toward said drain.

2. The construction according to claim 1 including means for also selectively providing drying air to said baseboard means.

3. The construction according to claim 1 including a partition between said chambers, said partition being provided with distribution slot means for communicating between said feeder chamber and said dispensing chamber.

4. The construction according to claim 1 including means for selectably deliverying air to said water distribution means.

5. The construction according to claim 1 wherein said water distribution means comprises rotatable spray nozzle means suspended from said ceiling.

6. The construction according to claim 1 further including adjustable wedge means underneath said floor for adjusting the slope thereof.

7. A construction according to claim 1 further including a closet provided with a clothes freshener portion, said clothes freshener portion having water distribution means for delivering a spray of water or mist toward clothes hung in said clothes freshener portion.

8. The construction according to claim 1 further including a cupboard dishwasher provided with means for storing dishes and means for providing a spray of water or mist for cleaning said dishes.

9. The construction according to claim 1 further including a bathtub provided with a rim having a multiplicity of water delivering orifices therearound for providing cleaning water to said bathtub, and passage means for delivering heated air around the wall of said bathtub.

10. The construction according to claim 1 wherein said means for providing water to said feeder chamber comprise pipe means extending into te rear of said feeder chamber.

11. The construction according to claim 1 further including a washbasin having a multiplicity of openings around the rim thereof for delivering cleaning liquid thereto.

12. The construction according to claim 11 wherein said walls are provided with flush window means.

13. The construction according to claim 1 including multi-pane windows, and molding means at the edges of panes thereof for distributing water across the panes of said windows.

14. The construction according to claim 1 further including a dry toilet having means for moving a refuse receiving liner thereacross.

* * * * *